US008707827B2

(12) United States Patent
Lemper

(10) Patent No.: US 8,707,827 B2
(45) Date of Patent: Apr. 29, 2014

(54) DEVICE FOR EXTRACTING A CORK FROM A BOTTLE

(76) Inventor: Brian Lemper, Las Vegas, NV (US)

( * ) Notice: Subject to any disclaimer, the term of this patent is extended or adjusted under 35 U.S.C. 154(b) by 40 days.

(21) Appl. No.: 13/567,543

(22) Filed: Aug. 6, 2012

(65) Prior Publication Data

US 2014/0033873 A1 Feb. 6, 2014

(51) Int. Cl.
*B67B 7/00* (2006.01)

(52) U.S. Cl.
USPC ..... 81/3.2; 81/3.37; 81/3.48

(58) Field of Classification Search
USPC ..... 81/3.2, 3.48, 3.45, 3.35
See application file for complete search history.

(56) References Cited

U.S. PATENT DOCUMENTS 2,729,124 A * 1/1956 Farandatos ..... 81/3.2
4,765,206 A * 8/1988 Poehlmann ..... 81/3.37
4,791,834 A 12/1988 Federighi
6,223,626 B1 5/2001 West
6,622,595 B1 * 9/2003 Federighi ..... 81/3.48
7,231,850 B2 6/2007 Wang
7,255,022 B1 * 8/2007 Rivera ..... 81/3.2

* cited by examiner

*Primary Examiner* — Lee D Wilson
*Assistant Examiner* — Melanie Alexander
(74) *Attorney, Agent, or Firm* — Vincent G. LoTempio; David T. Stephenson; Kloss, Stenger & LoTempio

(57) ABSTRACT

A device for extracting a cork from a bottle comprising a generally T-shaped handle mounted on a housing having an upper end and a lower end, a shaft which is operatively connected to handle for axial and rotational movement therewith, the shaft having a hollow passage with an air intake and an air exhausting hole. The shaft depending from the lower end of the housing for griping and penetrating the cork longitudinally thereby presenting the air exhausting hole to the interior of the bottle. A pump configured to push for selectively pumping air from the housing through the shaft into the bottle between the cork and the contents of the bottle such that air in the bottle forces the cork out of the bottle in conjunction with force applied by pulling the T-shaped handle.

6 Claims, 10 Drawing Sheets

DEVICE FOR EXTRACTING A CORK FROM A BOTTLE

BACKGROUND OF THE INVENTION

1. Field of the Invention

This invention relates to apparatus for uncorking wine bottles or similar containers. More particularly, the invention concerns an improved cork extraction device of the character in which the cork is penetrated by a hallow corkscrew and air is introduced between the cork and the contents of the bottle.

2. Background

Corks are traditionally used to close and seal wine bottles or the like. Use of a conventional corkscrew to extract the cork from the bottle subjects consumers of wine to a variety of problems. Substantial physical effort and dexterity on the part of the user of the corkscrew is required. A corkscrew sometimes creates a disruption in the cork, which allows the corkscrew to withdraw from the bottle without withdrawing the cork itself from the bottle, or causing the cork to splinter with remnants of the cork falling into the wine or liquid in the bottle.

Several devices have been invented to facilitate extracting corks from wine bottles or similar containers using pressurized fluid or air pressure to compel the cork out of the bottle. For example U.S. Pat. No. 4,791,834 issued to Federighi, discloses a device for extracting corks from a wine bottle or the like including a body and pressurized fluid container, a hollow needle extending from the body for penetration through the cork and annular one-way valve mechanism for selectively injecting pressurized fluid into the wine bottle through the needle to generate gas pressure which ejects the cork from the bottle. However, the '834 patent does not disclose an extraction device with an air pump. Additionally, the '834 patent does not disclose air pressure as a means to extract a cork from a bottle.

U.S. Pat. No. 6,223,626 issued to West, discloses a cork removal device for injecting air between the contents of a bottle to compel the cork out of the bottle. The '626 patent discloses a base portion and cap, with the base portion having a bottom wall. A needle for inserting into corks has a blunt end and a sharp end. The '626 patent further discloses an annular one-way valve located in the lumen of the needle. The annular one-way valve is adapted to allow airflow through the lumen, in one direction. To engage the device a cap is pressed into the interior of the base portion forcing air from the interior of the base portion through the needle and into the bottle between the cork and the contents of the bottle. The air forced into the bottle compels the cork out of the bottle. The '626 patent does not disclose a lever or rod member attached to the device. Furthermore, the '626 does not disclose a piston and spring method for extracting a cork from a bottle.

U.S. Pat. No. 7,231,850 issued to Wang, discloses a manual wine bottle opener including a main body, a fixing base, a piston rod, a press lever, an annular one-way valve base, a sleeve and a slide member combined together. By reciprocally pulling and pressing the press lever for moving the piston up and down repeatedly, air can be pumped into the wine bottle through the insert needle for removing the cork of the wine bottle from the bottle mouth. However, the '850 patent does not disclose a trigger mechanism for one-handed operation and extraction of a cork from a bottle.

Thus, it is readily apparent that there is a long felt need for a device for extracting a cork from a bottle with trigger mechanism to create air pressure.

SUMMARY OF THE INVENTION

A device for extracting a cork from a bottle comprising a generally T-shaped handle mounted on a housing having an upper end and a lower end, a shaft which is operatively connected to the handle for axial and rotational movement there with, the shaft having a hollow passage with an air intake and an air exhausting hole, the shaft depending from the lower end of the housing for griping and penetrating the cork longitudinally thereby presenting the air exhausting hole to the interior of the bottle. A pump for selectively pushing air from the housing through the shaft into the bottle between the cork and the contents of the bottle such that air in the bottle forces the cork out of the bottle in conjunction with force applied by pulling the T-shaped handle.

It is accordingly a primary object of the present invention to provide a corkscrew with a trigger mechanism, which creates air pressure between the cork and contents of the bottle ejecting the cork out of the bottle.

Another object of the invention is to provide a piston and spring assembly with an annular one-way valve with a stem, which creates air pressure when a trigger is engaged and the annular one-way valve door is closed.

Yet another object of the invention is to provide an in-line t-shaped handle as an alternative means to activate the piston and spring assembly and create air pressure to compel a cork out of a bottle with very little risk of damaging the cork.

A further object of the invention is to provide an easy and fast means to remove a cork from a bottle using a trigger to activate the opening and closing of an annular one-way valve door creating air pressure, which passes through an opening at the end of a corkscrew into the headspace of the bottle.

Another further object of the invention is to provide an improvement to the conventional corkscrew through the addition of a piston and spring system creating air pressure to extract a cork from a bottle with minimal physical effort by the user.

Additional objects and advantages will become apparent and a more thorough and comprehensive understanding may be had from the following description and claims taken in conjunction with the accompanying drawings forming a part of this specification.

BRIEF DESCRIPTION OF THE DRAWINGS

The present invention and the manner in which it may be practiced is further illustrated with reference to the accompanying drawings wherein.

DETAILED DESCRIPTION OF THE INVENTION

Figure 1:
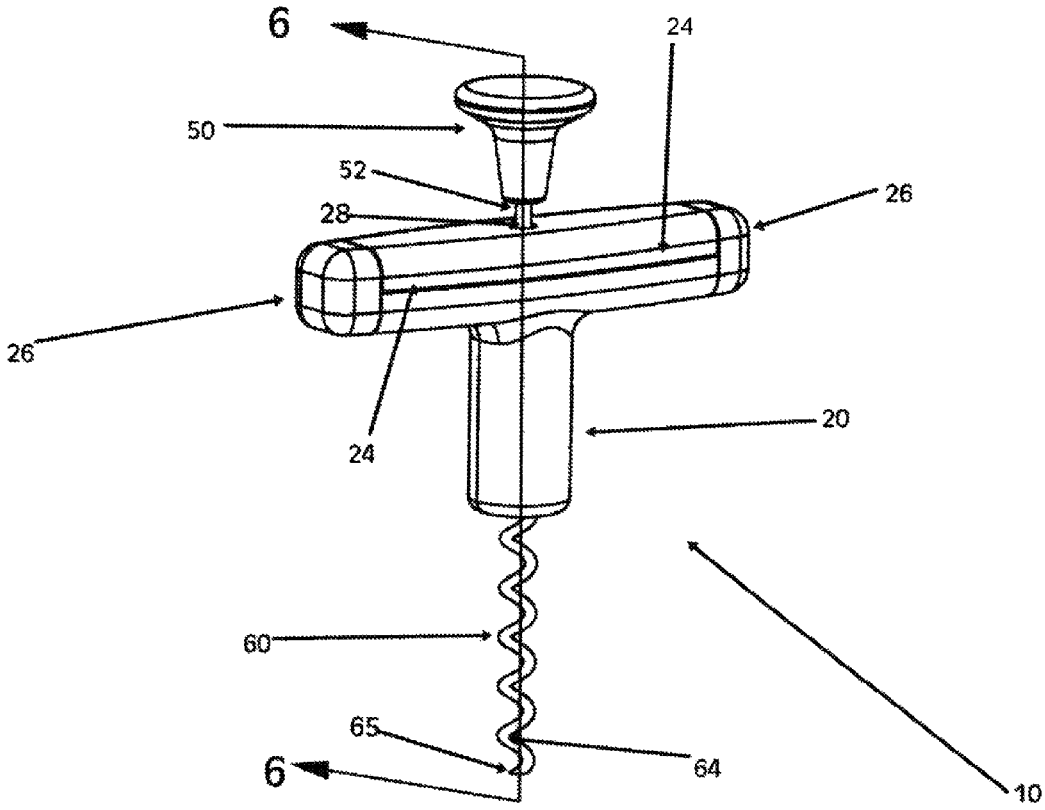
FIG. 1 is a front perspective view of a device for extracting a cork from a bottle.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Adverting now to the drawings, with reference to FIG. 1, a preferred embodiment of the present disclosure, a device for extracting a cork from a bottle is indicated generally by numeral 10 comprising a generally T-shaped handle mounted on a housing having an upper end and a lower end, a shaft which is operatively connected to the handle for axial and rotational movement there with. The shaft having a hollow passage with an air intake and an air exhausting hole. The shaft depending from the lower end of the housing for griping and penetrating the cork longitudinally, thereby presenting the air exhausting hole to the interior of the bottle. A pump, comprised of a piston, annular one-way valve and spring is controlled by a trigger mechanism for selectively pushing air from the housing through the shaft into the bottle between the cork and the contents of the bottle such that air in the bottle forces the cork out of the bottle in conjunction with force applied by pulling the T-shaped handle.

The device for extracting a cork from a bottle is comprised of a main housing and a generally t-shaped handle. The main housing is generally tubular and cylindrical and acts as a housing chamber for the piston, annular one-way valve and spring. Main housing 20 marries to t-shaped handle 24 and this assembly is sealed at the left and right ends by end caps 26. Much like a conventional corkscrew, the device for extracting a cork from a bottle is compact and made to fit into the hand of a person and thus configured to as a conventional handle to pull cork from a bottle. T-shaped handle 24 is configured for axial rotation of shaft 60 to facilitate penetration of the cork. Conventional corkscrews require the user to exert physical effort, and often require the user twist their hand or the wine bottle in an awkward position. This twisting and pulling often results in damage to the cork, with pieces of the cork falling into the wine or liquid contained in the bottle. The device for extracting a cork from a bottle simplifies the cork extraction process by using air pressure to extract the cork from the bottle.

Generally, a trigger mechanism is used to engage the pump. Although the trigger mechanism in a preferred embodiment is configured as a rod or lever suited to engage the pump, in the embodiment shown by FIG. 1 the trigger is a rod member affixed to a handle. Rod member 52 is positioned in the center of the device for extracting a cork from a bottle. Handle 50 is affixed to rod member 52; this assembly marries to the present disclosure, specifically the piston (shown in FIG. 5) contained in main housing 20. Rod member 52 is cylindrical having two ends. The first end marries to handle 50, in this case and the second end insets into air intake hole 28 oft-shaped handle 24, and marries to the piston (not shown). Hollow shaft 60 depending from the bottom of main housing 20. The hollow shaft is bent helically in a corkscrew spiral shape that extends downwardly from the lower end of the housing and is operatively arranged to be axially driven through the cork with an axial rotation to facilitate penetration. Hollow shaft 60 is not solid throughout like a conventional corkscrew; the hollow nature of the corkscrew provides a pathway for the pumped air to reach the interior of the bottle. Air exhausting hole 64 is located above the end of the hollow shaft. Air exhausting hole 64 is the opening, which allows the air captured in main housing 20 into the bottle. It should be appreciated that the air intake/exhausting hole's position cannot be on the end of the hollow shaft, but can be located at any position of the distal centimeter of hollow shaft. Tip with sharp point 65 is at the end of hollow shaft 60 and is used to pieces the cork when inserting the device for extracting a cork from a bottle.

Figure 2:
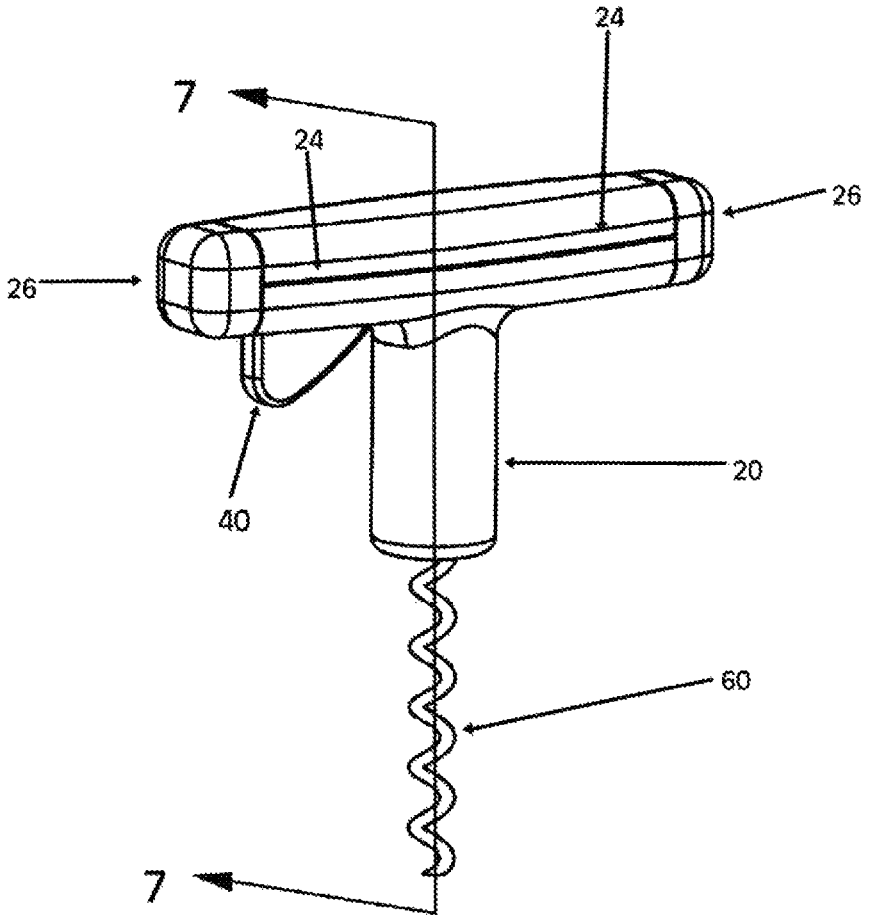
FIG. 2 is a front perspective view of a device for extracting a cork from a bottle with a lever.

FIG. 2 is a front perspective view of a device for extracting a cork from a bottle with a trigger mechanism configured as lever suited to engage the pump. The user grasps the device for extracting a cork from a bottle using t-shaped handle 24. While grasping t-shaped handle 24, the user, with the same hand is able to engage lever 40. The lever is located on one side of t-shaped handle 24. FIG. 2 illustrates lever 40 disengaged; in this position the annular one-way valve (shown in FIG. 5) contained in main housing 20 is not sealed. With lever 40 disengaged, no air will flow out of hollow shaft 60. Air will instead collect in the piston contained in the main housing and will be propelled through hollow shaft 60 when lever 40 is engaged (see FIG. 8). Hollow shaft 60 is attached to the bottom of main housing 20 by stopping part 62 (shown in FIG. 5).

Figure 3:
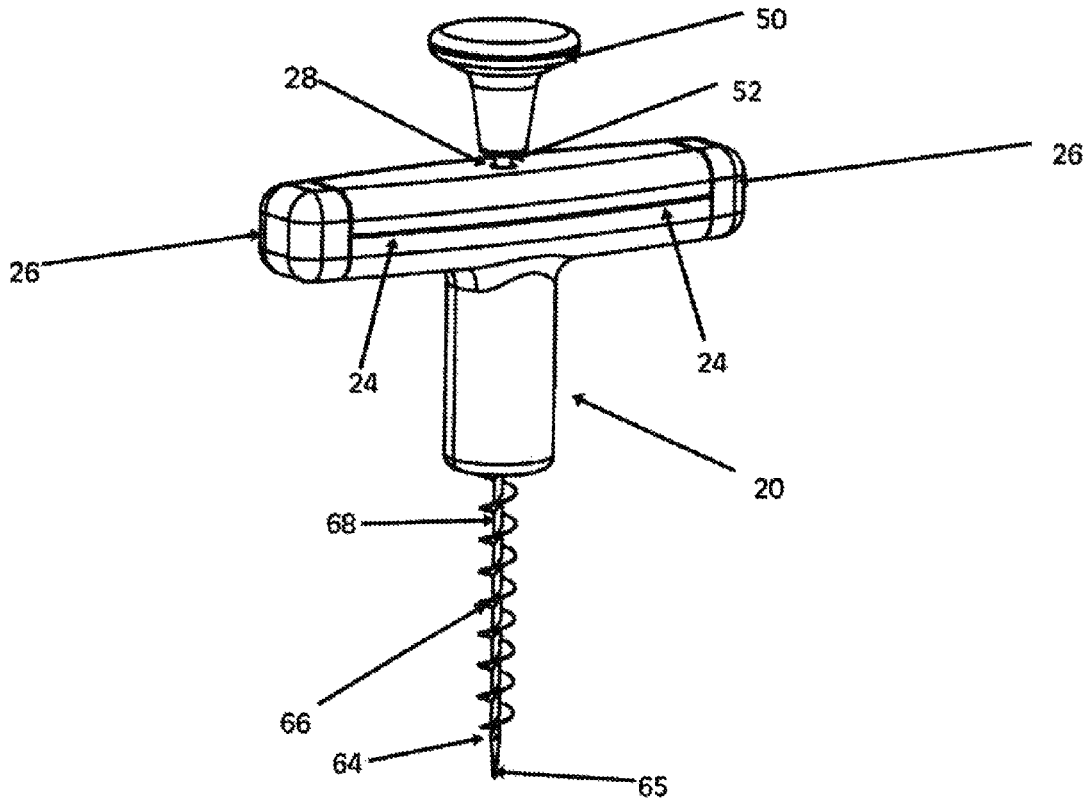
FIG. 3 is a front perspective view of a device for extracting a cork from a bottle with a longitudinal rod with an exterior spiral thread.
Figure 4:
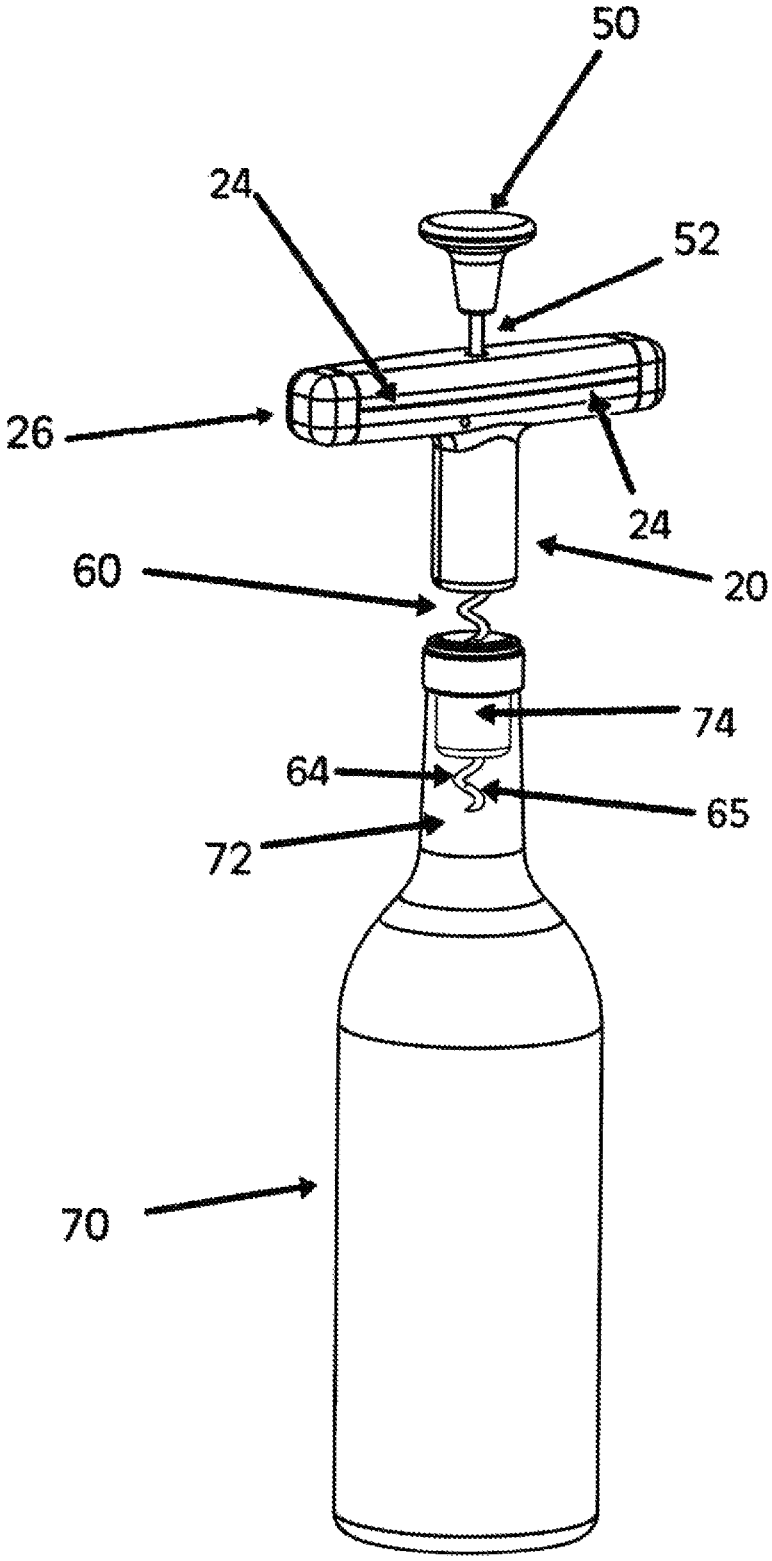
FIG. 4 is a front perspective view of a device for extracting cork from a bottle with a shaft inserted into a bottle.

FIG. 3 is a front perspective view of a device for extracting a cork from a bottle with shaft comprised of a longitudinal rod with an exterior spiral thread. Main housing 20 and t-shaped handle 24 are mounted together, and are sealed on the left and right edges by end caps 26. The main housing is generally tubular and cylindrical shaped and acts as a housing chamber for the piston, annular one-way valve and spring. Rod member 52 is inserted through air intakehole 28 of t-shaped handle 24. Longitudinal rod 68 depends from the bottom of main housing 20. The longitudinal rod is long enough to extend through a cork, and into the neck of the bottle. This embodiment of the shaft is tipped with sharp point 65 configured to pierce the surface of the cork upon insertion of the present disclosure into a cork. When the device for extracting a cork from a bottle is in use, air pressure is manually created by the user moving the trigger up and down (either by lever or in-line pump rod). User, with one hand, grasps handle 50 and pushes rod member 52 downward, causing air to flow through longitudinal rod 68, out of air exhausting hole 64 and into the bottle, forcing the cork upwards and eventually out of the bottle. FIG. 3 illustrates exterior spiral thread 66 wrapped around longitudinal rod 68. The exterior spiral thread forms a corkscrew shape around the longitudinal rod. The shaft comprises a combination of a longitudinal rod with an exterior spiral thread to thus simplify the cork extraction process. Exterior spiral thread 66 allows the user to insert the longitudinal rod into the cork in a spiral motion or axially driven through the cork with an axial rotation to facilitate penetration, preventing the cork from splitting in two pieces, as it might if only the longitudinal rod was used. Additionally, when the air pressure is forcing the cork upwards, the combination of exterior spiral thread 66 and longitudinal rod 68 provide stability and additional force to cleanly extract the cork from the bottle without the cork fracturing causing pieces of the cork to fall into the wine or liquid contained in the bottle. It should be appreciated that the embodiment of the present disclosure illustrated in FIG. 3 another embodiment of for the device for extracting a cork from a bottle. FIG. 4 is a front perspective view of a device for extracting cork from a bottle with a shaft inserted into a bottle. The device for extracting a cork from a bottle is comprised of main housing 20 and t-shaped handle 24 married together and sealed at the left and right ends by end caps 26. T-shaped handle 24 is used to insert the present disclosure into cork 74 of bottle 70. The user encircles t-shaped handle 24 with one hand, and while steadying the bottle with the other hand, the user begins to rotate t-shaped handle 24 initially exerting a slight downward pressure to drive tip with sharp point 65 into cork 74. Hollow shaft 60 protrudes through cork 74 far enough so that air exhausting hole 64 of hollow shaft 60 is in the neck 72 of bottle 70. This will allow air to flow into neck 72 of bottle 70 compelling cork 74 out of the bottle. FIG. 4 illustrates a preferred embodiment of the present disclosure with handle 50 affixed to rod member 52. The handle and rod member work in concert to engage the piston, spring and annular one-way valve (shown in FIG. 5) contained in main housing 20 to create the necessary air pressure. It should be appreciated the embodiment of the present disclosure shown in FIG. 2 is inserted into the bottle in the same manner as the embodiment illustrated in FIG. 4.

Figure 5:
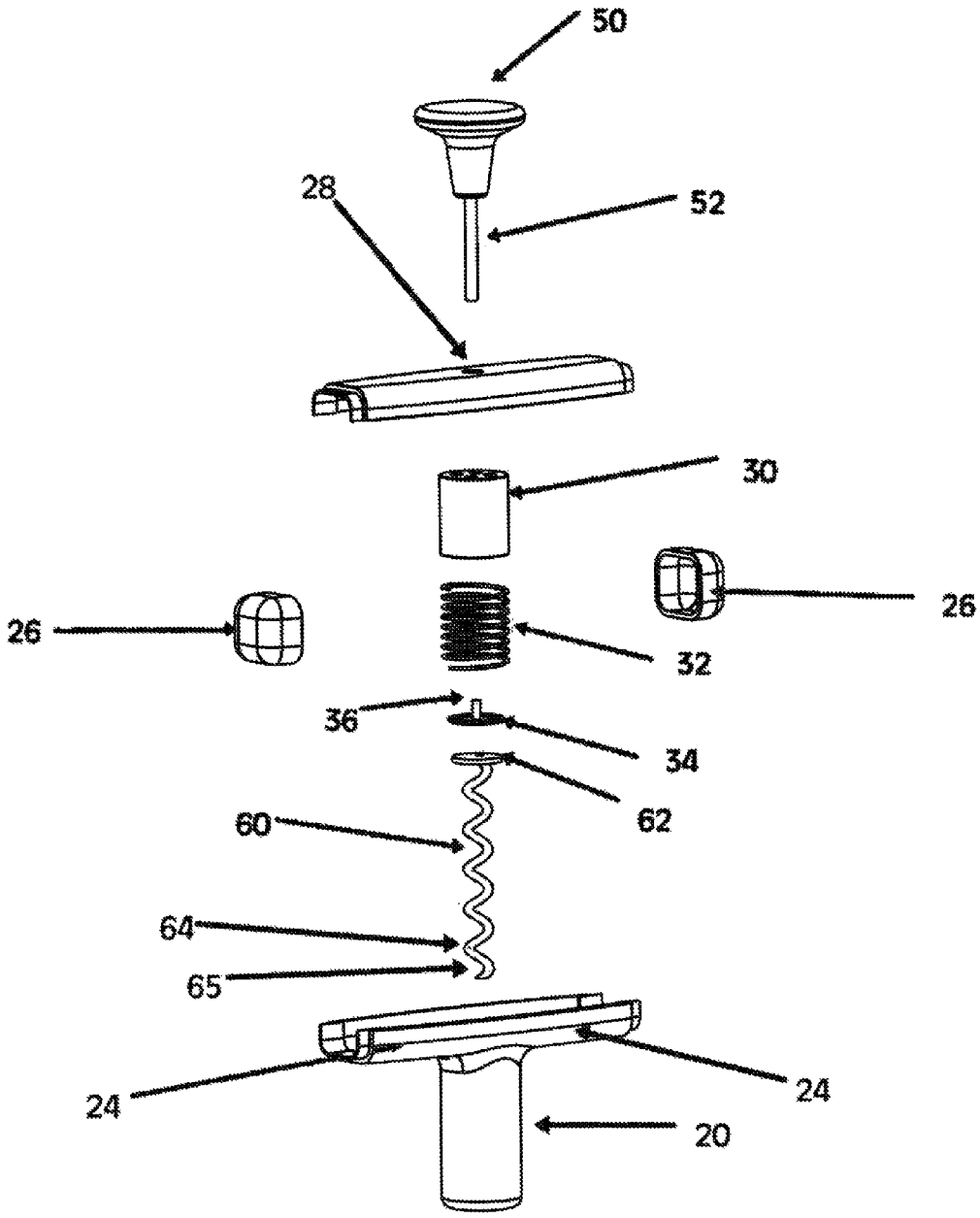
FIG. 5 is an exploded view of a device for extracting cork from a bottle.

FIG. 5 is an exploded view of another embodiment of a device for extracting cork from a bottle. FIG. 5 illustrates handle 50 affixed to rod member 52. The rod member is inserted through air intake hole 28 in t-shaped handle 24. When in use, main housing 20 is married to t-shaped handle 24 and sealed at the left and right ends by end caps 26. FIG. 5 illustrates piston 30 which is cylindrical in shape, spring 32 and annular one-way valve 34 all contained in main housing 20. Married to annular one-way valve 34 is stem 36, which allows the annular one-way valve to remain in the correct position, sealed to the bottom of piston 34, when the rod member is engaged. Annular one-way valve 34 has a diameter wide enough to seal the bottom of piston 30. The piston is cylindrical with a center opening. When engaged the annular one-way valve closes, sealing to the bottom of the piston, and the spring compresses creating air pressure to compel the cork out of the bottle. Married to the top of hollow shaft 60 is stopping point 62, which marries inside main housing 20, and specifically rests at the bottom of the main housing. Stopping point 62, is constructed from the same material as hollow shaft 60, and is generally circular in a preferred embodiment of the present disclosure, as the bottom of the main housing. Stopping point 62 marries securely to the bottom of the main housing, ensuring hollow shaft 60 remains secure during cork extraction process. Air exhausting hole 64 is located near the bottom of hollow shaft 60. At the end of hollow shaft 60 is tip with sharp point 65, which is used to pierce the surface of the cork.

Figure 6:
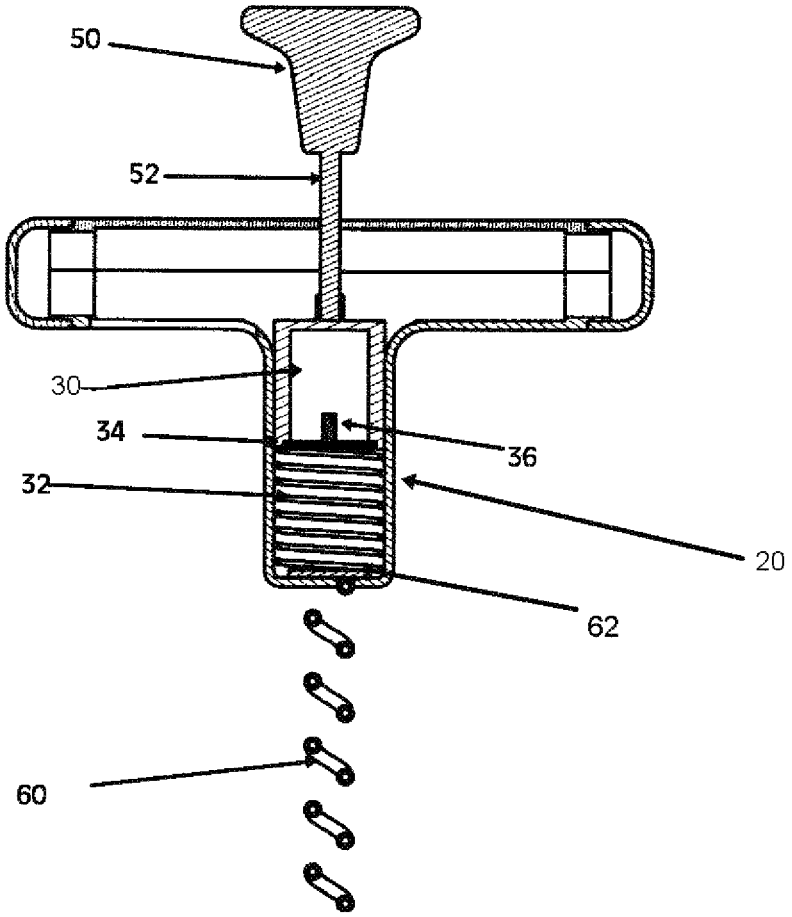
FIG. 6 is a cross-section view of a device for extracting cork from a bottle taken generally along line 6 of FIG. 1.

FIG. 6 is a cross-section view of a device for extracting cork from a bottle with rod member option taken generally along line 6 of FIG. 1. FIG. 6 shows a trigger composed of rod member 52 and handle 50 for moving a cylindrical piston between a first position at which the cylindrical piston is spaced from the lower end of the housing and a second position at which the cylindrical piston is closer to the lower end of the housing. Handle 50, affixed to rod member 52 is disengaged. FIG. 6 illustrates main housing 20 and t-shaped handle 24 married together; however, this marriage does not form an airtight seal. When the rod member is disengaged, spring 32, is fully expanded, allowing for the collection of air inside main housing 20. Annular one-way valve 34 with stem 36 creates a base at piston 30 above spring 32. Piston 30 positioned encloses stem 36. Hollow shaft 60 depends from the bottom of main housing 20. Stopping point 62 is mounted to hollow shaft 60, and this assembly is married to bottom of main housing 20. Hollow shaft 60 is hollow which allows the air created by the piston, spring and annular one-way valve mechanism to flow into a bottle and compel the cork out of the bottle.

Figure 7:
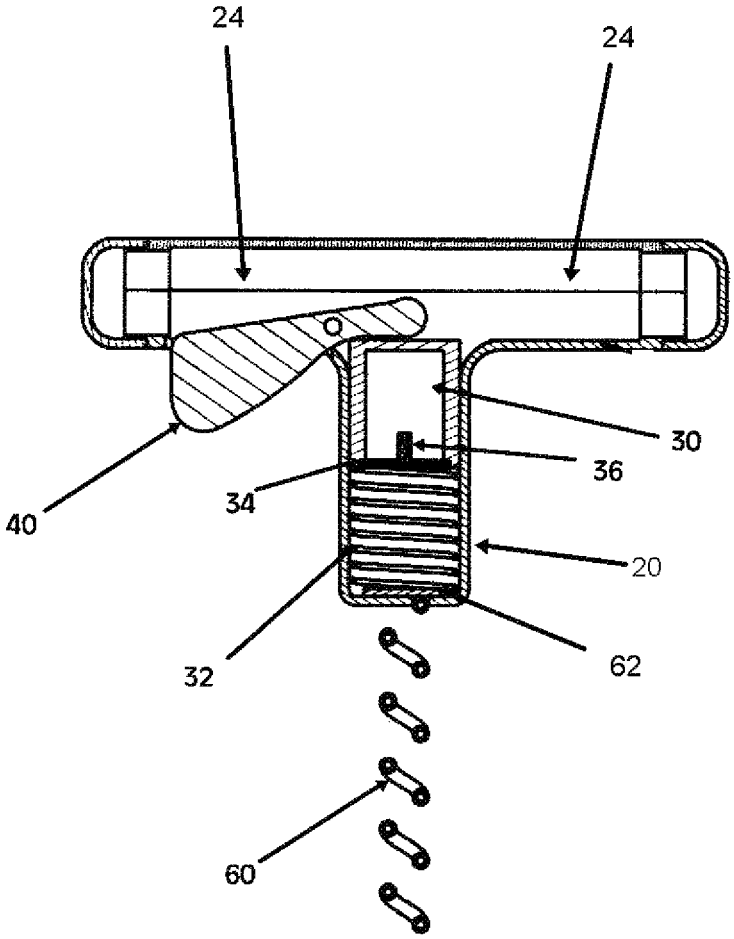
FIG. 7 is a cross-sectional view of a device for extracting cork from a bottle with lever disengaged taken generally along line 7 of FIG. 2.

FIG. 7 is a cross-sectional view of a device for extracting cork from a bottle with lever disengaged taken generally along line 7 of FIG. 2. FIG. 7 shows a trigger composed of lever 40 for moving a cylindrical piston between a first position (shown in FIG. 7) at which the cylindrical piston is spaced from the lower end of the housing and a second position (shown in FIG. 8) at which the cylindrical piston is closer to the lower end of the housing. The spring means 32 is for urging the cylindrical piston towards the first position thereof; and the annular one-way valve is positioned at the base of the cylindrical piston, wherein the annular one-way valve opens when the cylindrical piston is in the first position, to allow air to collect in the piston and wherein annular one-way valve 34 closes when the cylindrical piston is in the second position and seals air collected in the cylindrical piston to be forced in the air intake and out of the air exhausting hole and injected into the bottle to eject the cork from the bottle. Lever 40 is disengaged, allowing spring 32 to fully extend. With the lever disengaged, annular one-way valve 34 flexes and is not sealed to the bottom of piston 30. Stem 36, attached to annular one-way valve 34 is covered by piston 30. The stem also acts as a means to keep the annular one-way valve in the desired position. Main housing 20 and t-shape hollow handle 24 are married together; however, as with the rod member embodiment shown in FIG. 6, this marriage does not form an airtight seal. Hollow shaft 60 is married to stopping point 62, and this assembly is married to the bottom of main housing 20. Piston 30, spring 32 and annular one-way valve 34 are contained inside main housing 20. With the lever disengaged, spring 32 expands, urging piston 30 upwards, and air is captured inside main housing 20. This air will be pushed through hollow shaft 60 and into the bottle when the lever is engaged (shown in FIG. 8).

Figure 8:
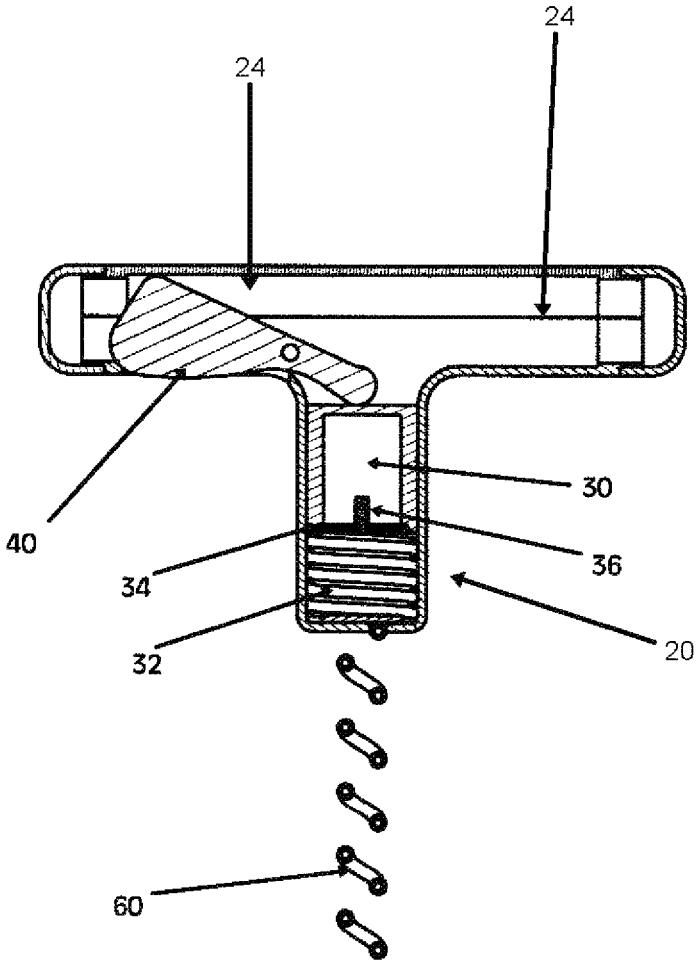
FIG. 8 is a cross-sectional view of a device for extracting cork from a bottle with lever engaged taken generally along line 7 of FIG. 2.

FIG. 8 is a cross-sectional view of a device for extracting cork from a bottle with lever engaged taken generally along line 7 of FIG. 2. Lever 40 is engaged causing it to press downward on piston 30. With lever 40 engaged, annular one-way valve 34 seals to piston 30 allowing the air created to flow from inside main housing 20 through the hollow shaft 60 and into a bottle. When engaged, lever 40 pushes down on piston 30, which in turn pushes down on spring 32; this squeezes air down into and through the hollow shaft. Stem 36 of annular one-way valve 34 is covered by piston 30 and remains inside the piston as the annular one-way valve begins to seal to piston 30. T-shaped handle 24 marries to main housing 20, but does not create an airtight seal. Together, this assembly provides a means for the user to grasp the device for extracting a cork from a bottle. T-shaped handle 24 should have enough depth to enclose lever 40 when engaged. This ensures the maximum amount of air pressure is created to compel the cork from the bottle with as few squeezes of the t-shaped handle as possible. It should be appreciated that the processes illustrated in FIGS. 7 and 8 show only one embodiment of the device for extracting a cork from a bottle. An additional embodiment, not illustrated, would include the trigger mechanism with the longitudinal rod and the exterior spiral thread shown in FIG. 3. In this additional embodiment, the cork extraction process is the same as illustrated by FIGS. 7 and 8.

Figure 9:
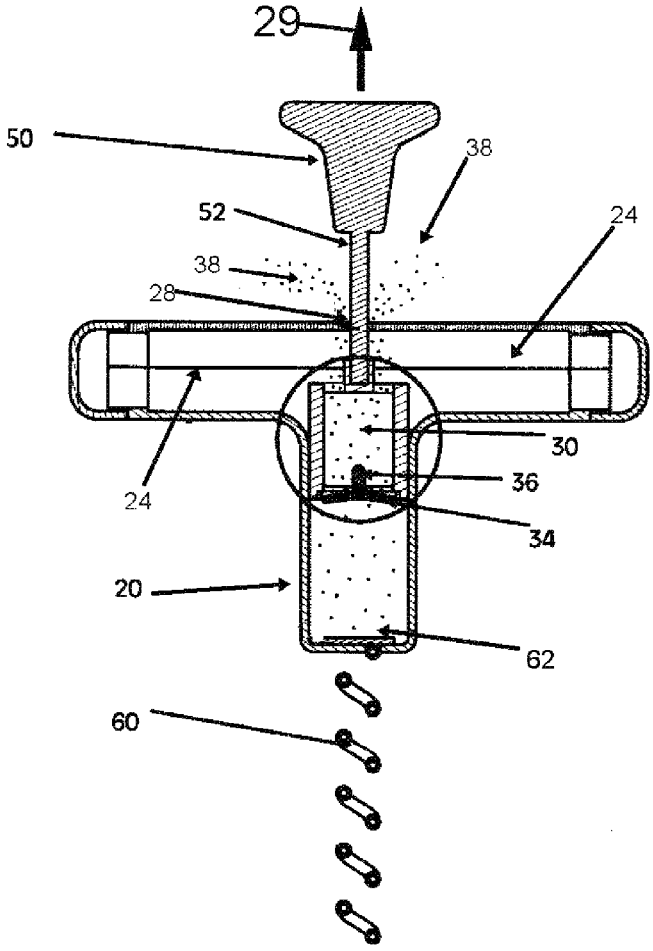
FIG. 9 is a cross-sectional view of a device for extracting cork from a bottle with rod member disengaged taken generally along line 6 of FIG. 1.

FIG. 9 is a cross-sectional view of a device for extracting cork from a bottle with rod member disengaged taken generally along line 6 of FIG. 1. Rod member 52 is disengaged by pulling upward on handle 50 as illustrated by arrow 29. Rod member 52 is married to piston 30. FIG. 9 illustrates, rod member drawing piston 30, annular one-way valve 34 and the spring (not shown) upward. The user, with one hand, grasps the device for extracting a cork from a bottle, using t-shaped handle 24, and with the other hand, grasps handle 50 and pulls upward drawing rod member 52 upward. The spring (not shown for clarity) expands and pushes piston 30 upwards. Concurrently, air 38 collects in main housing 20, and flows out of air intake hole 28 of t-shaped handle 24. Even though the t-shaped handle 24 is married to main housing 20, it is not air tight, which causes some air to escape from the present disclosure. The suction created by the expansion of the spring and flexing of annular one-way valve 34 draws a sufficient amount of air into the space vacated by the moving piston and the expanding spring. Stem 36 keeps annular one-way valve 34 in the preferred position, ensuring an ample amount of air remains contained in main housing 20. This contained air is pushed through hollow shaft 60 when the in-line pump rod is pushed downward, as illustrated in FIG. 11.

Figure 10:
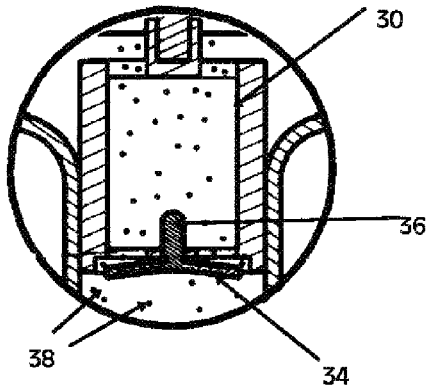
FIG. 10 is a magnified view of piston and stem taken along circle of FIG. 9.

FIG. 10 is a magnified view of piston and stem taken along circle of FIG. 9. Annular one-way valve 34 flexes and does not seal to the bottom of piston 30; however, air 38 is collected, generally, inside the main housing; more specifically inside the piston. Stem 36 keeps the annular one-way valve in proper position to allow for the collection of air inside the piston. The upward movement of the piston, caused by pulling the in-line pump rod upward, as illustrated in FIG. 9, draws annular one-way valve 34 upwards, and as the annular one-way valve flexes upwards annular one-way valve 34 expands; this process draws air inside main housing 20.

Figure 11:
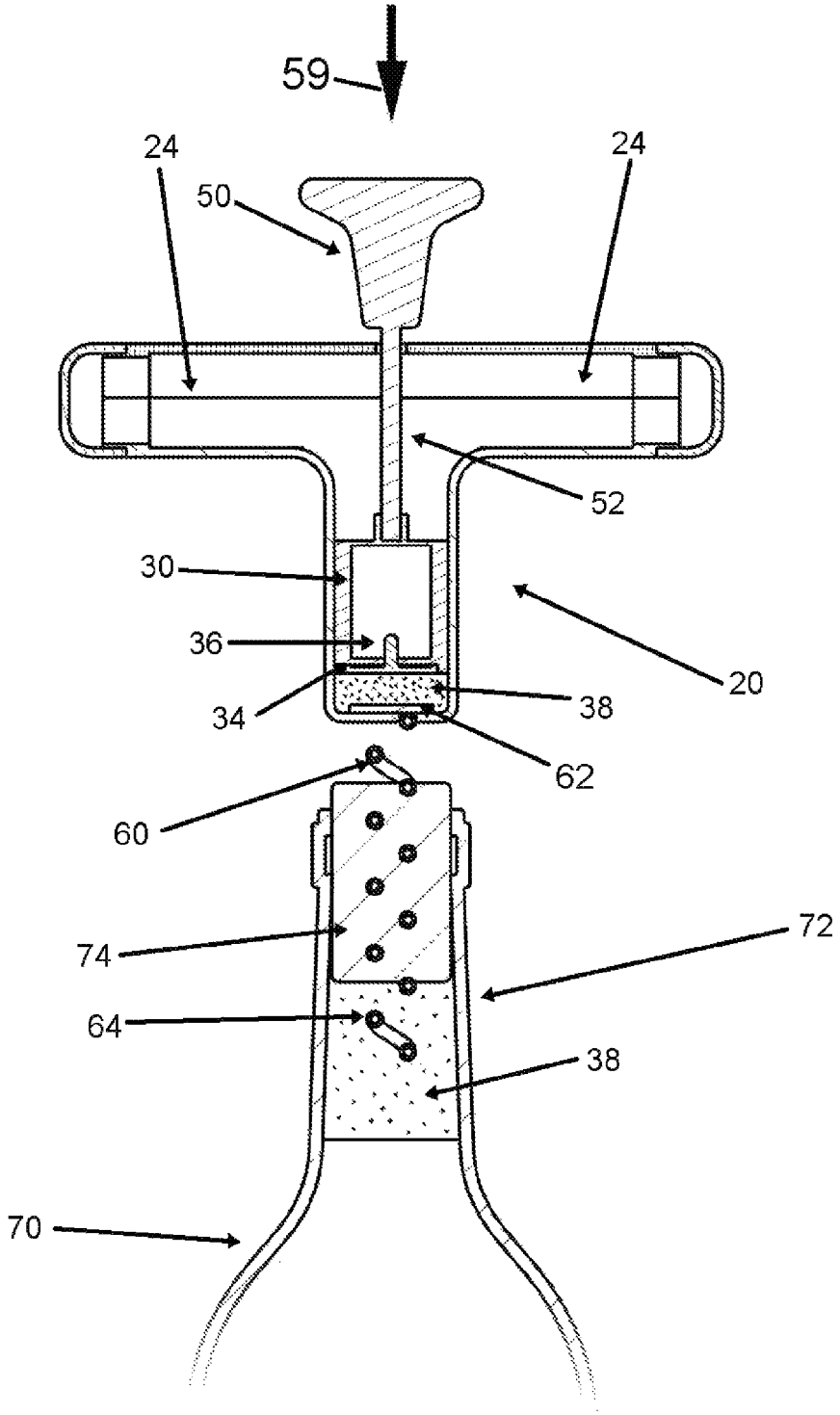
FIG. 11 is a cross-sectional view of a device for extracting cork from a bottle with rod member engaged taken generally along line 6 of FIG. 1.

FIG. 11 is a cross-sectional view of a device for extracting cork from a bottle with in-line pump rod engaged taken generally along line 6 of FIG. 1. Main housing 20 is married to t-shaped handle 24. Rod member 52 is engaged by pushing downward as in the general direction of arrow 59. Rod member 52 is married to piston 30. The length of rod member 52 allows longer strokes, reducing the number of strokes needed to extract the cork from the bottle. The user, with one hand, grasps the device for extracting a cork from a bottle, using t-shaped handle 24, and with the other hand, the user pushes downward on handle 50. When engaged, handle 50 and rod member 52 push piston 30, annular one-way valve 34 and the spring (not shown for clarity) downward and is compressed as piston 30 and annular one-way valve 34 move downward. Stem 36 ensures annular one-way valve 34 remains in the preferred position, sealed to piston 30. The marriage of the annular one-way valve to the bottom of piston 30 creates a sealed, although not airtight, mechanism, which forces air 38 through hollow shaft 60 and out air exhausting hole 64 into neck 72 of bottle 70. The pressure created from air 38 entering neck 72 of bottle 70 forces cork 74 upwards and eventually out of the bottle. It should be appreciated that the processes illustrated by FIGS. 9, 10 and 11 are only one embodiment of the device for extracting a cork from a bottle. Other embodiments include the in-line pump rod option with the longitudinal rod and the exterior spiral thread as shown in FIG. 3.

Although the invention as been described with reference to certain preferred embodiments, it will be appreciated by those skilled in the art that modifications and variations may be made without departing from the spirit and scope of the invention. It should be understood that applicant does not intend to be limited to the particular details described above and illustrated in the accompanying drawings. In this regard, the term "means for" as used in the claims is intended to include not only the designs illustrated in the drawings of this application and the equivalent designs discussed in the text, but it is also intended to cover other equivalents now known to those skilled in the art, or those equivalents which may become known to those skilled in the art in the future.

What is claimed is:

1. A device for extracting a cork from a bottle comprising: A generally T-shaped handle mounted on a housing having an upper end and a lower end, a shaft which is operatively connected to said housing for axial and rotational movement therewith, said shaft having a hollow passage with art air intake and an air exhausting hole, said shaft depending from said lower end of said housing for griping and penetrating the cork longitudinally;

a pump configured to push air from said housing through said shaft into said bottle between the cork and the contents of the bottle such that the air pushed ha the bottle forces the cork out of the bottle in conjunction with force applied by pulling said T-shaped handle; and wherein said pump comprises of a trigger for moving a cylindrical piston between a first position at which the cylindrical piston is spaced from the lower end of the housing and a second position at which the cylindrical piston is closer to said lower end of said housing, wherein said trigger is a lever which extends downwardly from said T-shaped handle and is operatively arranged to be incorporated into a cavity in said T-shaped handle and moves within said cavity to engage with said cylindrical piston;

a spring for urging said cylindrical piston towards said first position thereof;

an annular one-way valve at the base of said cylindrical piston, wherein said annular one-way valve opens when said cylindrical piston is in said first position, to allow air to collect in said piston and wherein said annular one-way valve closes when said cylindrical piston is in said second position and seals air collected in said cylindrical piston to be forced in said air intake and out of said air exhausting hole and injected into the bottle to eject the cork from the bottle; and a stem married to said annular one-way valve, wherein said stem allows said annular one-way valve to remain in a correct position, sealed to the bottom of said cylindrical piston, when said trigger is engaged.

2. The device for extracting a cork from a bottle of claim 1, wherein said shaft is a longitudinal rod with an exterior spiral thread with a helical shape that extends downwardly from said lower end of said housing and is operatively arranged to be axially driven through the cork with an axial rotation to facilitate cork penetration.

3. The device for extracting a cork from a bottle of claim 1, where said shaft is bent helically in a corkscrew spiral shape that extends downwardly from said lower end of said housing and is operatively arranged to be axially driven through the cork with an axial rotation to facilitate cork penetration.

4. The device for extracting a cork from a bottle of claim 1, wherein said shaft has a tip and wherein said exhausting hole is located at any position distal of said tip while presenting to the interior of the bottle.

5. A device for extracting a cork from a bottle comprising:

a generally T-shaped handle mounted on a housing having an upper end and a lower end, a shaft bent helically in a corkscrew spiral shape that extends downwardly from said lower end of said housing and is axially driven through the cork with an axial rotation to facilitate cork penetration, which is operatively connected to said housing for axial and rotational movement there with, said shaft having a hollow passage with an air intake and an air exhausting hole, said shaft depending from said lower end of said housing for griping and penetrating the cork longitudinally;

a trigger for moving a cylindrical piston between a first position at which the cylindrical piston is spaced from the lower end of the housing and a second position at which the cylindrical piston is closer to said lower end of said housing, wherein said trigger is a lever which extends downwardly from said T-shaped handle and is operatively arranged to be incorporated into a cavity in said T-shaped handle and moves within said cavity to engage with said cylindrical piston; and a spring for urging said cylindrical piston towards said first piston thereof; and an annular one-way valve at the base of said cylindrical piston, wherein said annular one-way valve at the base of said cylindrical piston, wherein said annular one-way valve opens when said cylindrical piston is in said first position, to allow air to collect in said piston and wherein said annular one-way valve closes when said cylindrical piston is in said second position and seals air collected in said cylindrical piston to be forced in said air intake and out of said air exhausting hole and injected into the bottle to eject the cork from the bottle.

6. The device for extracting a cork from a bottle of claim 5 wherein lever has a hinged movement.

* * * * *